US009384704B2

(12) United States Patent
Hu

(10) Patent No.: US 9,384,704 B2
(45) Date of Patent: Jul. 5, 2016

(54) LIQUID CRYSTAL DISPLAY AND GATE DRIVER THEREOF

(71) Applicant: NOVATEK MICROELECTRONICS CORP., HsinChu (TW)

(72) Inventor: Jen-Chieh Hu, Kaohsiung (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 176 days.

(21) Appl. No.: 14/250,903

(22) Filed: Apr. 11, 2014

(65) Prior Publication Data

US 2015/0042549 A1 Feb. 12, 2015

(30) Foreign Application Priority Data

Aug. 8, 2013 (TW) ..... 102128474 A

(51) Int. Cl.
*G09G 3/36* (2006.01)

(52) U.S. Cl.
CPC ..... *G09G 3/3677* (2013.01); *G09G 3/3614* (2013.01); *G09G 2310/06* (2013.01); *G09G 2310/063* (2013.01)

(58) Field of Classification Search
CPC . G09G 3/3614; G09G 3/3648; G09G 3/3674; G09G 3/3677
See application file for complete search history.

(56) References Cited

U.S. PATENT DOCUMENTS

| | | | | |
|---|---|---|---|---|
| 6,281,869 | B1 * | 8/2001 | Seino | G09G 3/3648 345/100 |
| 7,123,252 | B1 * | 10/2006 | Baek | G09G 3/3648 345/204 |
| 7,259,755 | B1 * | 8/2007 | Ahn | G09G 3/3614 345/204 |
| 8,253,679 | B2 * | 8/2012 | Kim | G09G 3/3659 345/99 |
| 2008/0042950 | A1 * | 2/2008 | Park | G09G 3/3677 345/87 |
| 2008/0218502 | A1 * | 9/2008 | Lee | G09G 3/3674 345/208 |
| 2009/0040161 | A1 * | 2/2009 | Baek | G11C 19/28 345/94 |
| 2009/0167746 | A1 * | 7/2009 | Yoon | G09G 3/3677 345/211 |
| 2010/0097366 | A1 * | 4/2010 | Kitayama | G09G 3/3655 345/213 |
| 2011/0292099 | A1 * | 12/2011 | Kim | G09G 3/3614 345/691 |
| 2014/0340600 | A1 * | 11/2014 | Yokonuma | G09G 3/3614 349/33 |
| 2015/0116008 | A1 * | 4/2015 | Jang | H03K 17/161 327/109 |
| 2015/0262528 | A1 * | 9/2015 | Takahara | G09G 3/3225 345/212 |

* cited by examiner

*Primary Examiner* — Ricardo L Osorio
(74) *Attorney, Agent, or Firm* — Rabin & Berdo, P.C.

(57) ABSTRACT

A liquid crystal display and a gate driver thereof are disclosed. The gate driver comprises a first output unit, a second output unit, a first counter, a second counter and a multiplex unit. The first counter counts a clock to control the first output unit to output odd gate driving signals according to a first start signal and a polarity signal. The second counter counts the clock to control the second output unit to output even gate driving signals according to a second start signal and the polarity signal. The multiplex unit selectively outputs the polarity signal to the first counter or the second counter.

20 Claims, 6 Drawing Sheets

LIQUID CRYSTAL DISPLAY AND GATE DRIVER THEREOF

This application claims the benefit of Taiwan application Serial No. 102128474, filed Aug. 8, 2013, the subject matter of which is incorporated herein by reference.

BACKGROUND OF THE INVENTION

1. Field of the Invention

The invention relates in general to an electronic device, and more particularly to a liquid crystal display and a gate driver thereof.

2. Description of the Related Art

Because a liquid crystal display (LCD) apparatus has the low power consumption, the low generated heat, the light weight and the non-radiative property, LCD apparatuses are used in various electronic products, and gradually replace the conventional cathode ray tube (CRT) display apparatuses. The liquid crystal molecule of the LCD apparatus possesses a property that the liquid crystal molecule cannot be always driven by the same voltage with the same polarity, or otherwise the property of the liquid crystal molecule is damaged after a long time and cannot rotate in response to the variation of the electric field even if the voltage is cancelled. Thus, the polarity of the voltage must be changed every other period of time to prevent the property of the liquid crystal molecule from being damaged.

At present, the frequently seen liquid crystal display panels may be classified into a normal pixel array and a flip pixel array. The polarity of the normal pixel array is switched by way of 1+2 line inversion, while the polarity of the flip pixel array is switched by way of column inversion. However, the flip pixel array has the smaller aperture ratio, while the polarity switching of the 1+2 line inversion has the higher power consumption. Thus, it is a very important subject to consider the high aperture ratio and the low power consumption.

SUMMARY OF THE INVENTION

The invention is directed to a liquid crystal display and a gate driver thereof.

According to a first aspect of the present invention, a liquid crystal display is provided. The liquid crystal display comprises odd scan lines, even scan lines, a normal pixel array, a data line, a data driver, a gate driver and a timing controller. The normal pixel array comprises odd rows of pixels and even rows of pixels. The odd rows of pixels are controlled by one of the odd scan lines. The even rows of pixels are controlled by one of the even scan lines, wherein the odd row of pixels and the even row of pixels neighbor each other and are disposed in the same column. The data line connects the odd row of pixels to the even row of pixels. The data driver is connected to the data line. The gate driver outputs a plurality of odd gate driving signals to the odd scan lines according to a clock, a first start signal and a polarity signal, and outputs a plurality of even gate driving signals to the even scan lines according to the clock, a second start signal and the polarity signal. The timing controller provides the clock and the polarity signal.

According to a second aspect of the present invention, a gate driver is provided. The gate driver comprises a first output unit, a second output unit, a first counter, a second counter and a multiplex unit. The first counter counts a clock to control the first output unit to output a plurality of odd gate driving signals according to a first start signal and a polarity signal. The second counter counts the clock to control the second output unit to output a plurality of even gate driving signals according to a second start signal and the polarity signal. The multiplex unit selectively outputs the polarity signal to the first counter or the second counter.

The above and other aspects of the invention will become better understood with regard to the following detailed description of the preferred but non-limiting embodiment(s). The following description is made with reference to the accompanying drawings.

DETAILED DESCRIPTION OF THE INVENTION

First Embodiment

Figure 1:
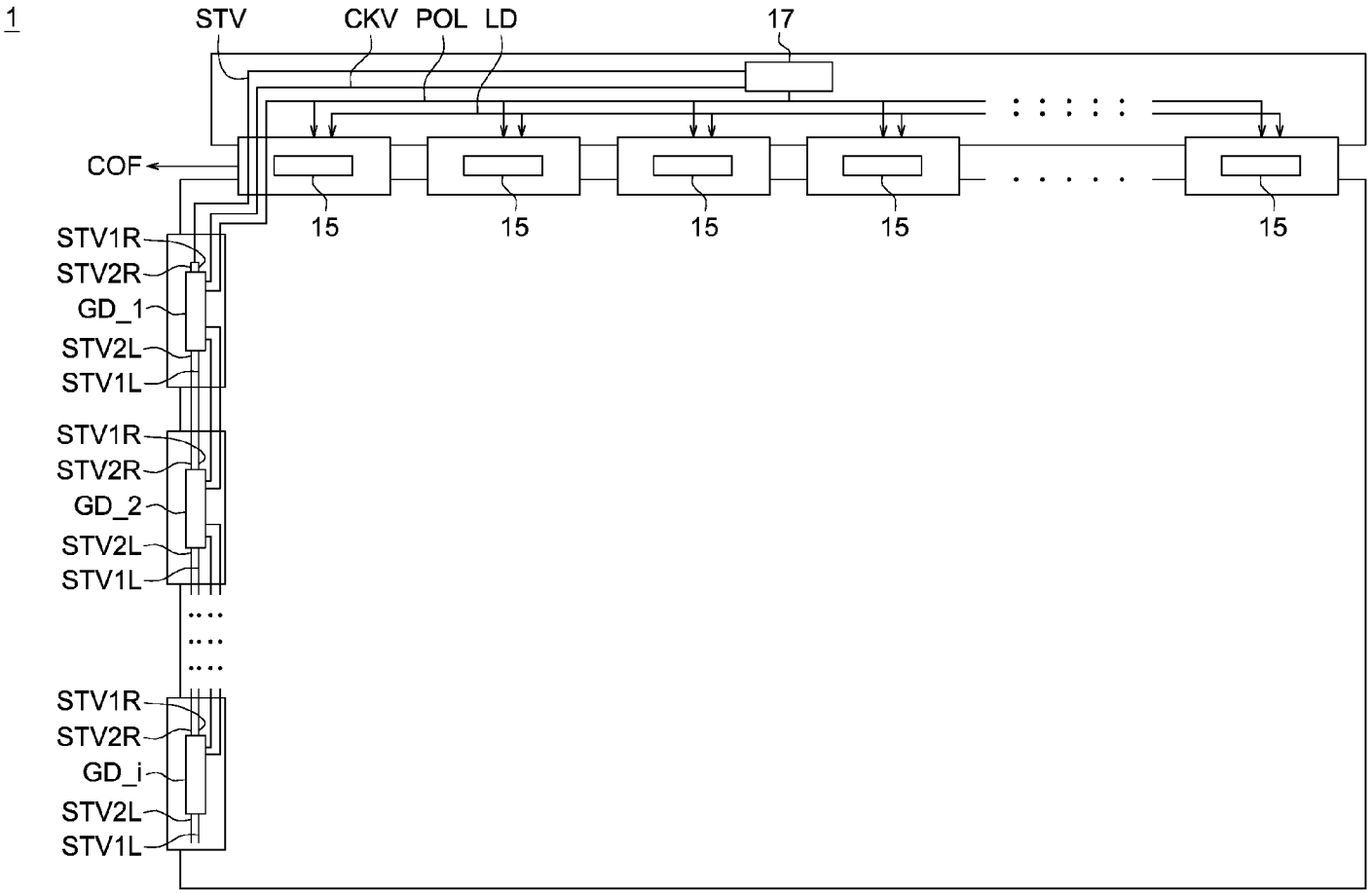
FIG. 1 is a schematic view showing a liquid crystal display according to a first embodiment.
Figure 2:
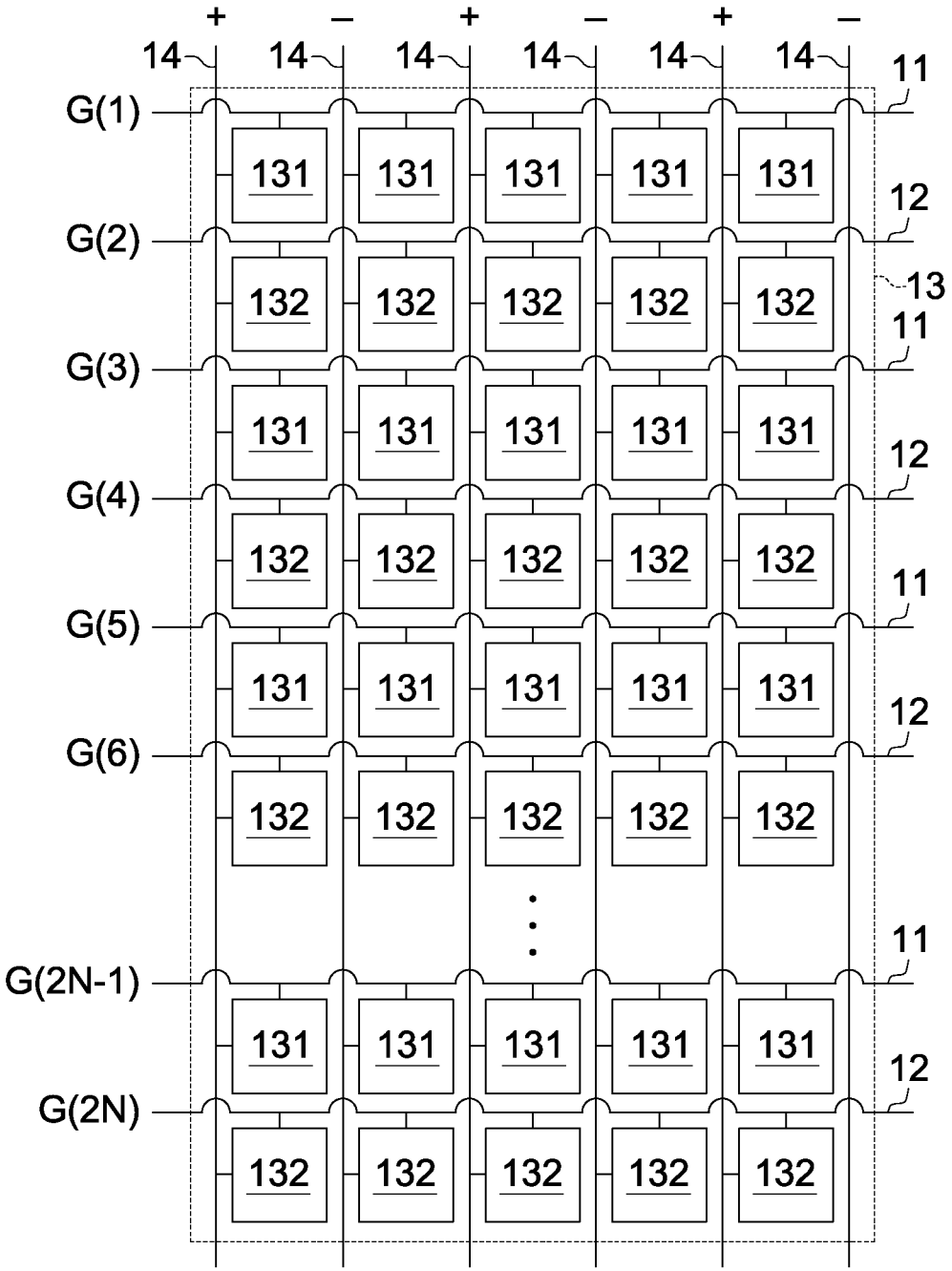
FIG. 2 is a schematic partial view showing scan lines, data lines, odd rows of pixels and even rows of pixels.

FIG. 1 is a schematic view showing a liquid crystal display 1 according to the first embodiment. FIG. 2 is a schematic partial view showing scan lines, data lines, odd rows of pixels and even rows of pixels. Referring to FIGS. 1 and 2, the liquid crystal display 1 comprises odd scan lines 11, even scan lines 12, a normal pixel array 13, data lines 14, data drivers 15, gate drivers GD_1 to GD_i and a timing controller 17, where "i" is a positive integer greater than 1. The gate driver GD_2 is a next stage of the gate driver GD_1, the gate driver GD_3 is a next stage of the gate driver GD_2, and so on, so that the gate driver GD_i is a next stage of the gate driver GD_i−1. The normal pixel array 13 comprises odd rows of pixels 131 and even rows of pixels 132. The odd rows of pixels 131 are controlled by one of the odd scan lines 11, and the even rows of pixels 132 are controlled by one of the even scan lines 12. The odd row of pixels 131 and the even row of pixels 132, which neighbor each other and are disposed in the same column, are connected to the same data lines 14.

Each of the gate drivers GD_1 to GD_i outputs a plurality of odd gate driving signals G(1), G (3), G(5), . . . , G(2N−1) to the odd scan lines 11 according to a clock CKV, a first start signal STV1R and a polarity signal POL, and outputs even gate driving signals G(2), G (4), G (6), . . . , G(2N) to the even scan lines 12 according to the clock CKV, a second start signal STV2R and the polarity signal POL, where N is a positive integer greater than 1. The timing controller 17 provides a latch enable signal LD, a start signal STV, the clock CKV and the polarity signal POL. The start signal STV may serve as the first start signal STV1R and the second start signal STV2R of the gate driver GD_1 in the first stage. The timing controller 17 can adjust the polarity signal POL to control a gate driver 16 to change the output order of the odd gate driving signals G(1), G (3), G(5), . . . , G(2N−1) and the even gate driving signals G(2), G (4), G (6), . . . , G(2N).

Figure 3:
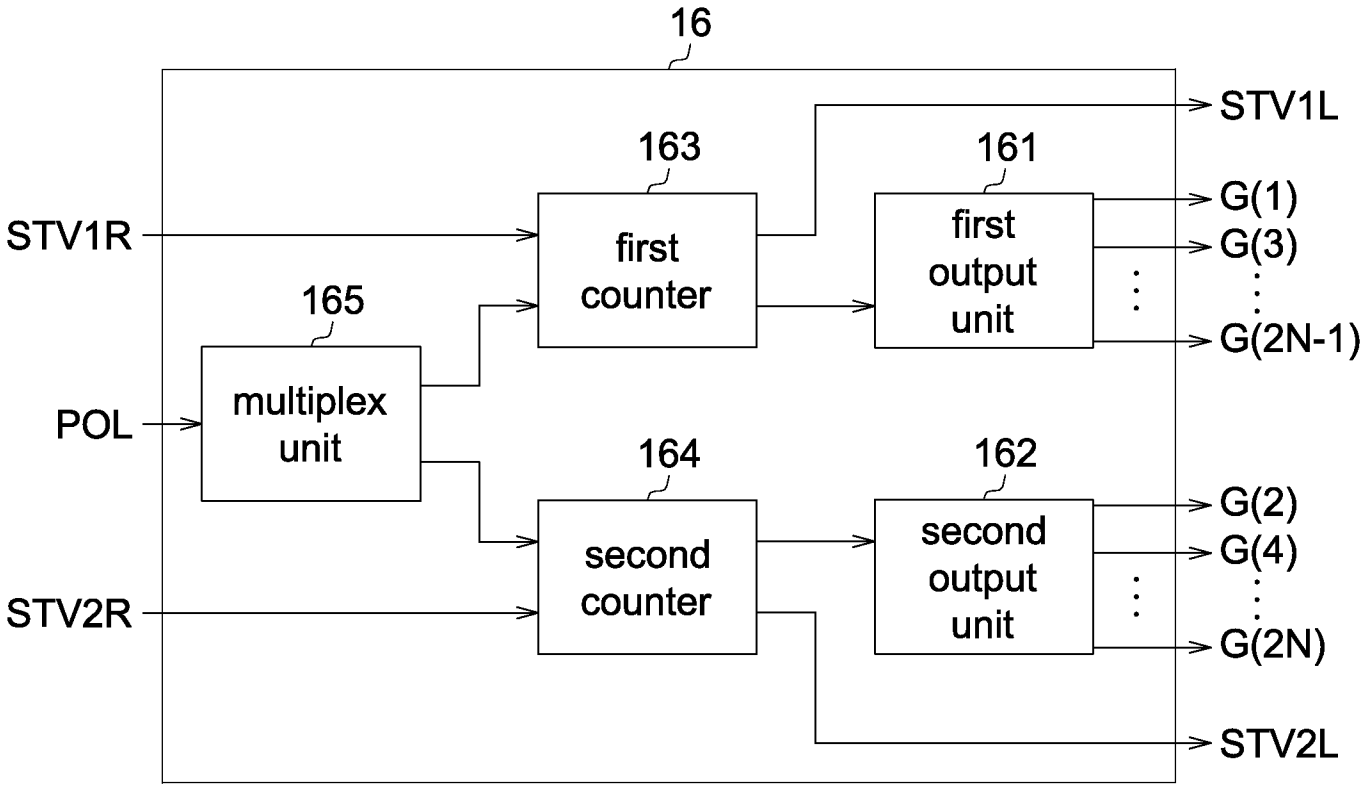
FIG. 3 is a schematic view showing a gate driver according to the first embodiment.

FIG. 3 is a schematic view showing the gate driver 16 according to the first embodiment. Referring to FIGS. 1 and 3, the gate drivers GD_1 to GD_i are described in FIG. 3 with reference to the gate driver 16 serving as an example. The gate driver 16 comprises a first output unit 161, a second output unit 162, a first counter 163, a second counter 164 and a multiplex unit 165. The first counter 163 is, for example, forward count, reverse count or jump count, and the second counter 164 is, for example, forward count, reverse count or jump count.

The first counter 163 counts the clock CKV to control the first output unit 161 to output the odd gate driving signals G(1), G (3), G(5), . . . , G(2N−1) according to the first start signal STV1R and the polarity signal POL. The second counter 164 counts the clock CKV to control the second output unit 162 to output the even gate driving signals G(2), G (4), G (6), . . . , G(2N) according to the second start signal STV2R and the polarity signal POL. The multiplex unit 165 selectively outputs the polarity signal POL to the first counter 163 or the second counter 164.

The first counter 163 outputs a third start signal STV1L to the gate driver of a next stage according to the first start signal STV1R and the polarity signal POL, wherein the third start signal STV1L is for disabling and resetting the first counter 163 of the present stage, and waking up the first counter 163 of a next stage. The second counter 164 outputs a fourth start signal STV2L to the gate driver of a next stage according to the second start signal STV2R and the polarity signal POL, wherein the fourth start signal STV2L is for disabling and resetting the second counter 164 of the present stage, and waking up the second counter 164 of the gate driver of a next stage.

For example, the first counter 163 of the gate driver GD_1 outputs the third start signal STV1L to the gate driver GD_2 according to the first start signal STV1R and the polarity signal POL, wherein the third start signal STV1L is for disabling and resetting the first counter 163 of the gate driver GD_1, and waking up the first counter 163 of the gate driver GD_2. The second counter 164 outputs the fourth start signal STV2L to the gate driver GD_2 according to the second start signal STV2R and the polarity signal POL, wherein the fourth start signal STV2L is for disabling and resetting the second counter 164 of the gate driver GD_1, and waking up the second counter 164 of the gate driver GD_2.

Figure 4:
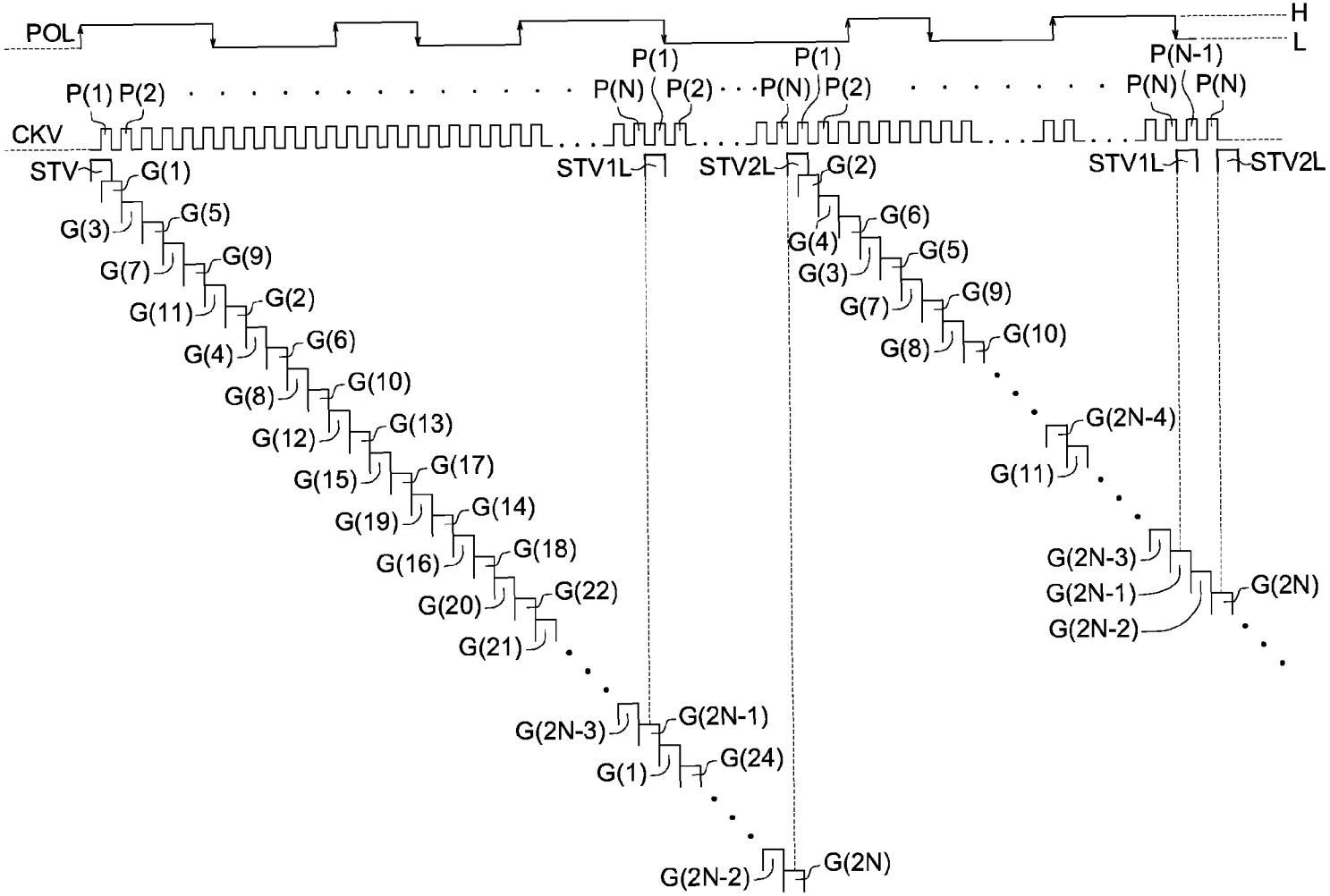
FIG. 4 shows a signal timing chart according to the first embodiment.

FIG. 4 shows a signal timing chart according to the first embodiment. Please refer to FIGS. 1, 3 and 4. For example, each of the first counter 163 and the second counter 164 is the forward count. After the gate driver GD_1 receives the start signal STV and the polarity signal POL changes from a second level L to a first level H, the first counter 163 of the gate driver GD_1 counts the clock CKV to control the first output unit 161 to output the odd gate driving signals G(1), G(3), G(5), G(7), G(9) and G(11). The clock CKV comprises a first clock P(1) to an $(N)^{th}$ clock P(N), and the first level H is higher than the second level L. Next, after the polarity signal POL changes from the first level H to the second level L, the second counter 164 of the gate driver GD_1 counts the clock CKV to control the second output unit 162 to output the even gate driving signals G(2), G(4), G(6), G(8), G(10) and G(12).

Then, after the polarity signal POL changes from the second level L to the first level H, the first counter 163 of the gate driver GD_1 counts the clock CKV to control the first output unit 161 to output the odd gate driving signals G(13), G(15), G(17) and G(19). Thereafter, after the polarity signal POL changes from the first level H to the second level L, the second counter 164 of the gate driver GD_1 counts the clock CKV to control the second output unit 162 to output the even gate driving signals G(14), G(16), G(18), G(20) and G(22).

Next, after the polarity signal POL changes from the second level L to the first level H, the first counter 163 counts the clock CKV to control the first output unit 161 to output the odd gate driving signals G(21), . . . , G(2N−3), G(2N−1) and G(1). When the first counter 163 counts the $(N)^{th}$ clock P(N) of the clock CKV, the third start signal STV1L is outputted as the first start signal STV1R of the gate driver GD_2. The third start signal STV1L is for disabling and resetting the first counter 163 of the gate driver GD_1, and waking up the first counter 163 of the gate driver GD_2. The first counter 163 of the gate driver GD_2 starts to count the clock CKV. The first counter 163 of the gate driver GD_2 counts the clock CKV to control the first output unit 161 to output an odd gate driving signal G(1).

Then, after the polarity signal POL changes from the first level H to the second level L, the second counter 164 counts the clock CKV to control the second output unit 162 to output the even gate driving signals G(24), . . . , G(2N−2) and G(2N). When the second counter 164 of the gate driver GD_2 counts the $(N)^{th}$ clock P(N) of the clock CKV, the fourth start signal STV2L is outputted as the second start signal STV2R of the gate driver GD_2. The fourth start signal STV2L is for disabling and resetting the second counter 164 of the gate driver GD_1, and waking up the second counter 164 of the gate driver GD_2. The second counter 164 of the gate driver GD_2 starts to count the clock CKV. The second counter 164 of the gate driver GD_2 counts the clock CKV to control the second output unit 162 to output the even gate driving signals G(2), G(4) and G(6).

Next, after the polarity signal POL changes from the second level L to the first level H, the first counter 163 of the gate driver GD_2 counts the clock CKV to control the first output unit 161 to output the odd gate driving signals G(3), G(5), G(7) and G(9). Then, after the polarity signal POL changes from the first level H to the second level L, the second counter 164 of the gate driver GD_2 counts the clock CKV to control the second output unit 162 to output the even gate driving signals G(8), G(10), . . . , G(2N−4). Next, after the polarity signal POL changes from the second level L to the first level H, the first counter 163 of the gate driver GD_2 counts the clock CKV to control the first output unit 161 to output the odd gate driving signals G(11), . . . , G(2N−3) and G(2N−1).

When the first counter 163 of the gate driver GD_2 counts the $(N)^{th}$ clock P(N) of the clock CKV, the third start signal STV1L is outputted as the first start signal STV1R of the gate driver GD_3. The third start signal STV1L is for disabling and resetting the first counter 163 of the gate driver GD_2, and waking up the first counter 163 of the gate driver GD_3. Next, the second counter 164 of the gate driver GD_2 counts the clock CKV to control the second output unit 162 to output the even gate driving signals G(2N−2) and G(2N). When the second counter 164 of the gate driver GD_2 counts the $(N)^{th}$ clock P(N) of the clock CKV, the fourth start signal STV2L is outputted as the second start signal STV2R of the gate driver GD_3, and so on. Thus, the output order of the odd gate driving signals G(1), G (3), G(5), . . . , G(2N−1) and the even gate driving signals G(2), G (4), G (6), . . . , G(2N) of the gate drivers GD_3 to GD_i can be obtained.

Second Embodiment

Figure 5:
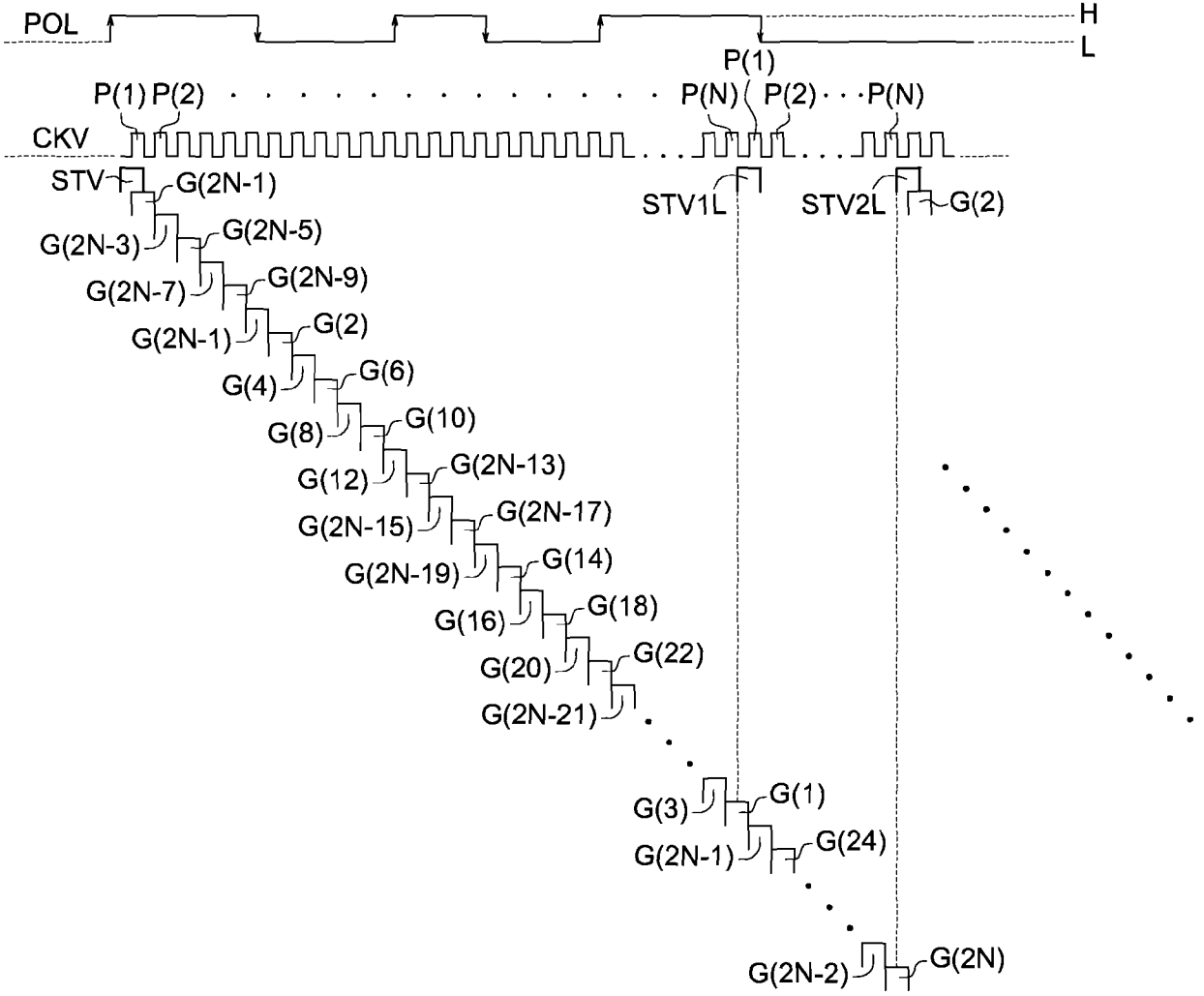
FIG. 5 shows a signal timing chart according to a second embodiment.

FIG. 5 shows a signal timing chart according to the second embodiment. Referring to FIGS. 1, 3 and 5, the difference between the second and first embodiments mainly resides in that the first counter 163 of the second embodiment is the reverse count, and the second counter 164 is the forward count. After the gate driver GD_1 receives the start signal STV and the polarity signal POL changes from the second level L to the first level H, the first counter 163 of the gate driver GD_1 counts the clock CKV to control the first output unit 161 to output the odd gate driving signals G(2N−1), G(2N−3), G(2N−5), G(2N−7), G(2N−9) and G(2N−11). Next, after the polarity signal POL changes from the first level H to the second level L, the second counter 164 of the gate driver GD_1 counts the clock CKV to control the second output unit 162 to output the even gate driving signals G(2), G(4), G(6), G(8), G(10) and G(12).

Thereafter, after the polarity signal POL changes from the second level L to the first level H, the first counter 163 of the gate driver GD_1 counts the clock CKV to control the first output unit 161 to output the odd gate driving signals G(2N−13), G(2N−15), G(2N−17) and G(2N−19). Then, after the polarity signal POL changes from the first level H to the second level L, the second counter 164 of the gate driver GD_1 counts the clock CKV to control the second output unit 162 to output the even gate driving signals G(14), G(16), G(18), G(20) and G(22).

Next, after the polarity signal POL changes from the second level L to the first level H, the first counter 163 counts the clock CKV to control the first output unit 161 to output the odd gate driving signals G(2N−21), . . . , G(3) and G(1). When the first counter 163 counts the $(N)^{th}$ clock P(N) of the clock CKV, the third start signal STV1L is outputted as the first start signal STV1R of the gate driver GD_2. The third start signal STV1L is for disabling and resetting the first counter 163 of the gate driver GD_1, and waking up the first counter 163 of the gate driver GD_2. The first counter 163 of the gate driver GD_2 starts to count the clock CKV. The first counter 163 of the gate driver GD_2 counts the clock CKV to control the first output unit 161 to output an odd gate driving signal G(2N−1).

Then, after the polarity signal POL changes from the first level H to the second level L, the second counter 164 counts the clock CKV to control the second output unit 162 to output the even gate driving signals G(24), . . . , G(2N−2) and G(2N). When the second counter 164 of the gate driver GD_2 counts the $(N)^{th}$ clock P(N) of the clock CKV, the fourth start signal STV2L is outputted as the second start signal STV2R of the gate driver GD_2. The fourth start signal STV2L is for disabling and resetting the second counter 164 of the gate driver GD_1, and waking up the second counter 164 of the gate driver GD_2. The second counter 164 of the gate driver GD_2 starts to count the clock CKV. The second counter 164 of the gate driver GD_2 counts the clock CKV to control the second output unit 162 to output the even gate driving signal G(2) again.

Third Embodiment

Figure 6:
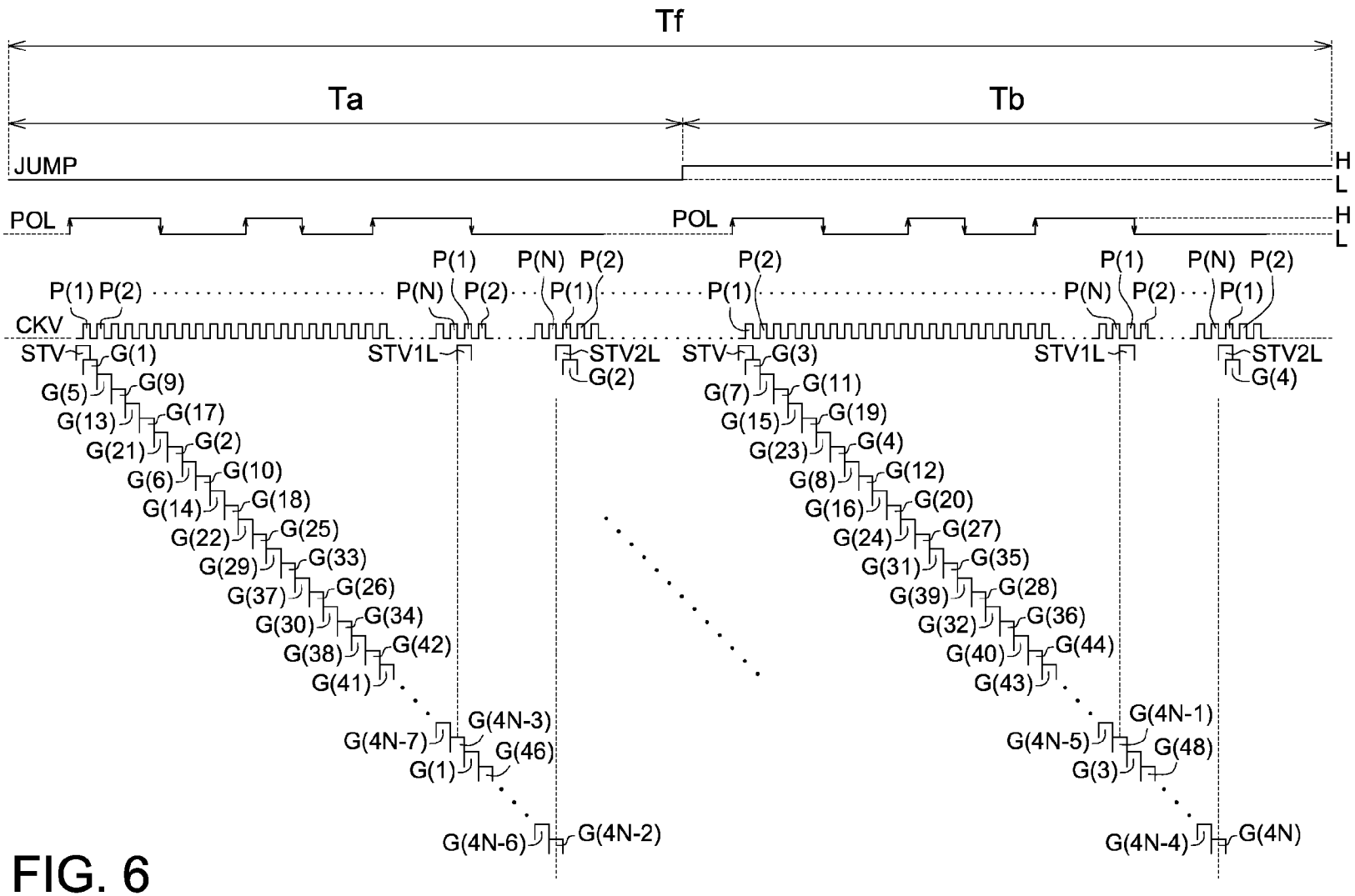
FIG. 6 shows a signal timing chart according to a third embodiment.

FIG. 6 shows a signal timing chart according to the third embodiment. Referring to FIGS. 1, 3 and 6, the difference between the third and first embodiments mainly resides in that each of the first counter 163 and the second counter 164 of the third embodiment is the jump count. A frame time Tf comprises a time interval Ta and a time interval Tb. The time interval Ta is one half of the frame time Tf, and the time interval Tb is one half of the frame time Tf. In the time interval Ta, a jump signal JUMP is equal to the second level L. In the time interval Tb, the jump signal JUMP is equal to the first level H.

In the time interval Ta, after the polarity signal POL changes from the second level L to the first level H and when the jump signal JUMP is equal to the second level L, the first counter 163 counts the clock CKV to control the first output unit 161 to output the $(4n-3)^{th}$ gate driving signal. After the polarity signal POL changes from the first level H to the second level L and when the jump signal is equal to the second level L, the second counter 164 counts the clock CKV to control the second output unit 162 to output the $(4n-2)^{th}$ gate driving signal, where n is a positive integer greater than 1.

In the time interval Tb, after the polarity signal POL changes from the second level L to the first level H and when the jump signal JUMP is equal to the first level H, the first counter 163 counts the clock CKV to control the first output unit 161 to output the $(4n-1)^{th}$ gate driving signal. After the polarity signal POL changes from the first level H to the second level L and when the jump signal JUMP is equal to the first level H, the second counter 164 counts the clock CKV to control the second output unit 162 to output the $(4n)^{th}$ gate driving signal.

For example, in the time interval Ta, after the gate driver GD_1 receives the start signal STV and the polarity signal POL changes from the second level L to the first level H, the first counter 163 of the gate driver GD_1 counts the clock CKV to control the first output unit 161 to output the odd gate driving signals G(1), G(5), G(9), G(13), G(17) and G(21). Next, after the polarity signal POL changes from the first level H to the second level L, the second counter 164 of the gate driver GD_1 counts the clock CKV to control the second output unit 162 to output the even gate driving signals G(2), G(6), G(10), G(14), G(18) and G(22).

Then, after the polarity signal POL changes from the second level L to the first level H, the first counter 163 of the gate driver GD_1 counts the clock CKV to control the first output unit 161 to output the odd gate driving signals G(25), G(29), G(33) and G(37). Next, after the polarity signal POL changes from the first level H to the second level L, the second counter 164 of the gate driver GD_1 counts the clock CKV to control the second output unit 162 to output the even gate driving signals G(26), G(30), G(34), G(38) and G(42).

Then, after the polarity signal POL changes from the second level L to the first level H, the first counter 163 counts the clock CKV to control the first output unit 161 to output the odd gate driving signals G(41), . . . , G(4N−7) and G(4N−3). When the first counter 163 counts the $(N)^{th}$ clock P(N) of the clock CKV, the third start signal STV1L is outputted as the first start signal STV1R of the gate driver GD_2. The third start signal STV1L is for disabling and resetting the first counter 163 of the gate driver GD_1, and waking up the first counter 163 of the gate driver GD_2. The first counter 163 of the gate driver GD_2 starts to count the clock CKV. The first counter 163 of the gate driver GD_2 counts the clock CKV to control the first output unit 161 to output the odd gate driving signal G(1).

Next, after the polarity signal POL changes from the first level H to the second level L, the second counter 164 counts the clock CKV to control the second output unit 162 to output the even gate driving signals G(46), . . . , G(4N−6) and G(4N−2). When the second counter 164 of the gate driver GD_2 counts the $(N)^{th}$ clock P(N) of the clock CKV, the fourth start signal STV2L is outputted as the second start signal STV2R of the gate driver GD_2. The fourth start signal STV2L is for disabling and resetting the second counter 164 of the gate driver GD_1, and waking up the second counter 164 of the gate driver GD_2. The second counter 164 of the gate driver GD_2 starts to count the clock CKV. The second counter 164 of the gate driver GD_2 counts the clock CKV to control the second output unit 162 to output the even gate driving signal G(2) again.

In the time interval Tb, after the gate driver GD_1 receives the start signal STV and the polarity signal POL changes from the second level L to the first level H, the first counter 163 of the gate driver GD_1 counts the clock CKV to control the first output unit 161 to output the odd gate driving signals G(3), G(7), G(11), G(15), G(19) and G(23). Next, after the polarity signal POL changes from the first level H to the second level L, the second counter 164 of the gate driver GD_1 counts the clock CKV to control the second output unit 162 to output the even gate driving signals G(4), G(8), G(12), G(16), G(20) and G(24).

Then, after the polarity signal POL changes from the second level L to the first level H, the first counter 163 of the gate driver GD_1 counts the clock CKV to control the first output unit 161 to output the odd gate driving signals G(27), G(31), G(35) and G(39). Next, after the polarity signal POL changes from the first level H to the second level L, the second counter 164 of the gate driver GD_1 counts the clock CKV to control the second output unit 162 to output the even gate driving signals G(28), G(32), G(36), G(40) and G(44).

Then, after the polarity signal POL changes from the second level L to the first level H, the first counter 163 counts the clock CKV to control the first output unit 161 to output the odd gate driving signals G(43), . . . , G(4N−5) and G(4N−1). Next, when the first counter 163 counts the $(N)^{th}$ clock P(N) of the clock CKV, the third start signal STV1L is outputted as the first start signal STV1R of the gate driver GD_2. The third start signal STV1L is for disabling and resetting the first counter 163 of the gate driver GD_1, and waking up the first counter 163 of the gate driver GD_2. The first counter 163 of the gate driver GD_2 starts to count the clock CKV. The first counter 163 of the gate driver GD_2 counts the clock CKV to control the first output unit 161 to output the odd gate driving signal G(3).

Next, after the polarity signal POL changes from the first level H to the second level L, the second counter 164 counts the clock CKV to control the second output unit 162 to output the even gate driving signals G(48), . . . , G(4N−4) and G(4N). When the first counter 163 of the gate driver GD_2 counts the $(N)^{th}$ clock P(N) of the clock CKV, the fourth start signal STV2L is outputted as the second start signal STV2R of the gate driver GD_2. The fourth start signal STV2L is for disabling and resetting the second counter 164 of the gate driver GD_1, and waking up the second counter 164 of the gate driver GD_2. The second counter 164 of the gate driver GD_2 starts to count the clock CKV. The second counter 164 of the gate driver GD_2 counts the clock CKV to control the second output unit 162 to output the even gate driving signal G(4) again.

In the liquid crystal display and the gate driver thereof, the applied pixel array may be in the form of the normal pixel array to increase the aperture ratio. In addition, the data driver applied to the liquid crystal display and the gate driver thereof may adopt the column inversion driving method to drive the normal pixel array to decrease the power consumption.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A gate driver, comprising:

a first output unit;

a second output unit;

a first counter for counting a clock to control the first output unit to output a plurality of odd gate driving signals according to a first start signal and a polarity signal;

a second counter for counting the clock to control the second output unit to output a plurality of even gate driving signals according to a second start signal and the polarity signal; and a multiplex unit for selectively outputting the polarity signal to the first counter or the second counter.

2. The gate driver according to claim 1, wherein an output order of the odd gate driving signals and the even gate driving signals is controlled by the polarity signal.

3. The gate driver according to claim 1, wherein: after the polarity signal changes from a second level to a first level, the first counter counts the clock to control the first output unit to output the odd gate driving signals; and after the polarity signal changes from the first level to the second level, the second counter counts the clock to control the second output unit to output the even gate driving signals, wherein the first level is higher than the second level.

4. The gate driver according to claim 1, wherein the first counter outputs a third start signal to another gate driver, which is a next stage of the gate driver, according to the first start signal and the polarity signal.

5. The gate driver according to claim 4, wherein the second counter outputs a fourth start signal to another gate driver, which is a next stage of the gate driver, according to the second start signal and the polarity signal.

6. The gate driver according to claim 1, wherein the odd gate driving signals comprises a (4n−3)th gate driving signal, the even gate driving signals comprises a (4n−2)th gate driving signal, and n is a positive integer greater than 1, wherein: after the polarity signal changes from a second level to a first level and a jump signal is equal to the second level, the first counter counts the clock to control the first output unit to output the (4n−3)th gate driving signal; after the polarity signal changes from the first level to the second level and the jump signal is equal to the second level, the second counter counts the clock to control the second output unit to output the (4n−2)th gate driving signal; and the first level is higher than the second level.

7. The gate driver according to claim 1, wherein the odd gate driving signals comprises a (4n−1)th gate driving signal, the even gate driving signals comprises a (4n)th gate driving signal, and n is a positive integer greater than 1, wherein: after the polarity signal changes from a second level to a first level and a jump signal is equal to the first level, the first counter counts the clock to control the first output unit to output the (4n−1)th gate driving signal; after the polarity signal changes from the first level to the second level and the jump signal is equal to the first level, the second counter counts the clock to control the second output unit to output the (4n)th gate driving signal; and the first level is higher than the second level.

8. The gate driver according to claim 1, wherein the first counter is forward count, reverse count or jump count.

9. The gate driver according to claim 1, wherein the second counter is forward count, reverse count or jump count.

10. The gate driver according to claim 1, wherein the first counter is reverse count, and the second counter is forward count.

11. A liquid crystal display, comprising:

a plurality of odd scan lines;

a plurality of even scan lines;

a normal pixel array, comprising:

an odd row of pixels controlled by one of the odd scan lines; and an even row of pixels controlled by one of the even scan lines, wherein the odd row of pixels and the even row of pixels neighbor each other and are disposed in the same column;

a data line connecting the odd row of pixels to the even row of pixels;

a data driver connected to the data line;

a gate driver for outputting a plurality of odd gate driving signals to the odd scan lines according to a clock, a first start signal and a polarity signal, and outputting a plurality of even gate driving signals to the even scan lines according to the clock, a second start signal and the polarity signal; and a timing controller for providing the clock and the polarity signal.

12. The liquid crystal display according to claim 11, wherein the timing controller adjusts the polarity signal to control the gate driver to change an output order of the odd gate driving signals and the even gate driving signals.

13. The liquid crystal display according to claim 11, wherein the gate driver comprises:

a first output unit;

a second output unit;

a first counter for counting the clock to control the first output unit to output the odd gate driving signals according to the first start signal and the polarity signal;

a second counter for counting the clock to control the second output unit to output the even gate driving signals according to the second start signal and the polarity signal; and a multiplex unit for selectively outputting the polarity signal to the first counter or the second counter.

14. The liquid crystal display according to claim 13, wherein: after the polarity signal changes from a second level to a first level, the first counter counts the clock to control the first output unit to output the odd gate driving signals; and after the polarity signal changes from the first level to the second level, the second counter counts the clock to control the second output unit to output the even gate driving signals; and the first level is higher than the second level.

15. The liquid crystal display according to claim 13, further comprising another gate driver, which is disposed in a next stage of the gate driver, wherein the first counter outputs a third start signal to the another gate driver according to the first start signal and the polarity signal, and the third start signal is for disabling and resetting the first counter.

16. The liquid crystal display according to claim 13, further comprising another gate driver, which is disposed in a next stage of the gate driver, wherein the second counter outputs a fourth start signal to the another gate driver according to the second start signal and the polarity signal, and the fourth start signal is for disabling and resetting the second counter.

17. The liquid crystal display according to claim 13, wherein the odd gate driving signals comprises a (4n−3)th gate driving signal, the even gate driving signals comprises a (4n−2)th gate driving signal, and n is a positive integer greater than 1, wherein after the polarity signal changes from a second level to a first level and a jump signal is equal to the second level, the first counter counts the clock to control the first output unit to output the (4n−3)th gate driving signal; after the polarity signal changes from the first level to the second level and the jump signal is equal to the second level, the second counter counts the clock to control the second output unit to output the (4n−2)th gate driving signal; and the first level is higher than the second level.

18. The liquid crystal display according to claim 13, wherein the odd gate driving signals comprises a (4n−1)th gate driving signal, the even gate driving signals comprises a (4n)th gate driving signal and n is a positive integer greater than 1, wherein after the polarity signal changes from a second level to a first level and a jump signal is equal to the first level, the first counter counts the clock to control the first output unit to output the (4n−1)th gate driving signal; after the polarity signal changes from the first level to the second level and the jump signal is equal to the first level, the second counter counts the clock to control the second output unit to output the (4n)th gate driving signal; and the first level is higher than the second level.

19. The liquid crystal display according to claim 13, wherein the first counter forward counts, reverse counts or jump counts.

20. The liquid crystal display according to claim 13, wherein the second counter forward counts, reverse counts or jump counts.

* * * * *